United States Patent [19]

Glennon et al.

[11] 4,164,034

[45] Aug. 7, 1979

[54] COMPRESSOR SURGE CONTROL WITH PRESSURE RATE OF CHANGE CONTROL

[75] Inventors: Timothy F. Glennon; Theodore E. Sarphie; Dennis T. Faulkner, all of Rockford, Ill.

[73] Assignee: Sundstrand Corporation, Rockford, Ill.

[21] Appl. No.: 833,032

[22] Filed: Sep. 14, 1977

[51] Int. Cl.[2] ..... F02C 9/14; F04D 27/02

[52] U.S. Cl. ..... 364/431; 60/39.29; 415/17; 415/39

[58] Field of Search ..... 364/431; 340/27 SS; 415/1, 27, 28; 73/115–117; 60/39.29

[56] References Cited

U.S. PATENT DOCUMENTS

| | | | |
|---|---|---|---|
| 3,138,317 | 6/1964 | Jekat | 415/148 |
| 3,292,845 | 12/1966 | Hens et al. | 415/17 |
| 3,292,846 | 12/1966 | Harper et al. | 415/17 |
| 3,411,702 | 11/1968 | Metot et al. | 415/27 |
| 3,424,370 | 1/1969 | Law | 415/27 |
| 3,852,958 | 12/1974 | Adams et al. | 340/27 SS |
| 3,867,717 | 2/1975 | Moehring et al. | 340/27 SS |
| 3,868,625 | 2/1975 | Speigner et al. | 340/27 SS |
| 3,935,558 | 1/1976 | Miller et al. | 340/27 SS |
| 3,938,319 | 2/1976 | Thomson | 73/115 |

*Primary Examiner*—Felix D. Gruber

*Attorney, Agent, or Firm*—Wegner, Stellman, McCord, Wiles & Wood

[57] ABSTRACT

A surge control system for controlling and preventing a surge condition and a method of controlling surge in a fixed or variable speed compressor or a compressor having a variable geometry which provides air to a pneumatic load. A transducer provides a signal proportional to the outlet pressure of the air from the compressor. The signal is differentiated with respect to time and if a surge condition is ensuing, the absolute value of the differentiated signal is greater than a reference. When the differentiated signal is greater than the reference, a portion of the air supplied to the load is vented to reduce the outlet pressure. A reduction in the outlet pressure alleviates the ensuing surge condition and the absolute value of the differentiated signal decreases, causing the venting valve to close.

5 Claims, 4 Drawing Figures

COMPRESSOR SURGE CONTROL WITH PRESSURE RATE OF CHANGE CONTROL

BACKGROUND OF THE INVENTION

This invention relates to control systems for controlling the operation of gas compressor systems to avoid a surge condition and, more particularly, to a system for regulating the ratio of the outlet pressure to the inlet pressure to prevent surge.

Gas compressor systems which supply air pressure to pneumatic loads are subject to the occurrence of an undesirable condition commonly referred to as surge. Although the reason for the occurrence of surge is not fully understood, its effect is extremely detrimental. For example, when a surge condition occurs in the compressor system, the airflow may suddenly reverse and air provided to the pneumatic load may cease or be interrupted. If the surge condition is permitted to continue, the compressor can enter a deep surge condition causing damage to its internal components.

SUMMARY OF THE INVENTION

In accordance with the present invention, surge is controlled by a signal proportional to the rate of change of the outlet pressure with respect to time. The rate of change of the outlet pressure beyond a particular value is indicative of an ensuring surge condition. The outlet pressure is measured and differentiated and a signal representing the absolute value of the differentiated signal is provided to a transfer function which provides a vent valve command signal. The vent valve command signal controls a valve which vents a portion of the air supplied to the load. If the absolute value of the rate of change of the outlet pressure increases beyond the particular value, a vent valve is opened to reduce the outlet pressure, thereby preventing a surge condition from occurring. As the absolute value of the rate of change of the outlet pressure decreases to a level lower than the preset level, the valve is closed.

It is an object of the present invention to prevent and control surge by the use of a signal proportional to the absolute value of the rate of change of the output pressure with respect to time.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF PREFERRED EMBODIMENT

The outlet pressure of a compressor oscillates at an increased amplitude as the outlet pressure of the compressor increases for a given weight flow rate, W. Increased oscillations of the output pressure are a precursor to the undesirable surge condition and are utilized herein to provide a vent valve command signal which controls the position of a venting valve. The venting valve vents a portion of the air provided to a pneumatic load to reduce the output pressure, thus avoiding an ensuing surge condition. The vent valve command signal causes the valve to close when the oscillations have returned to an acceptable level.

Figure 1:
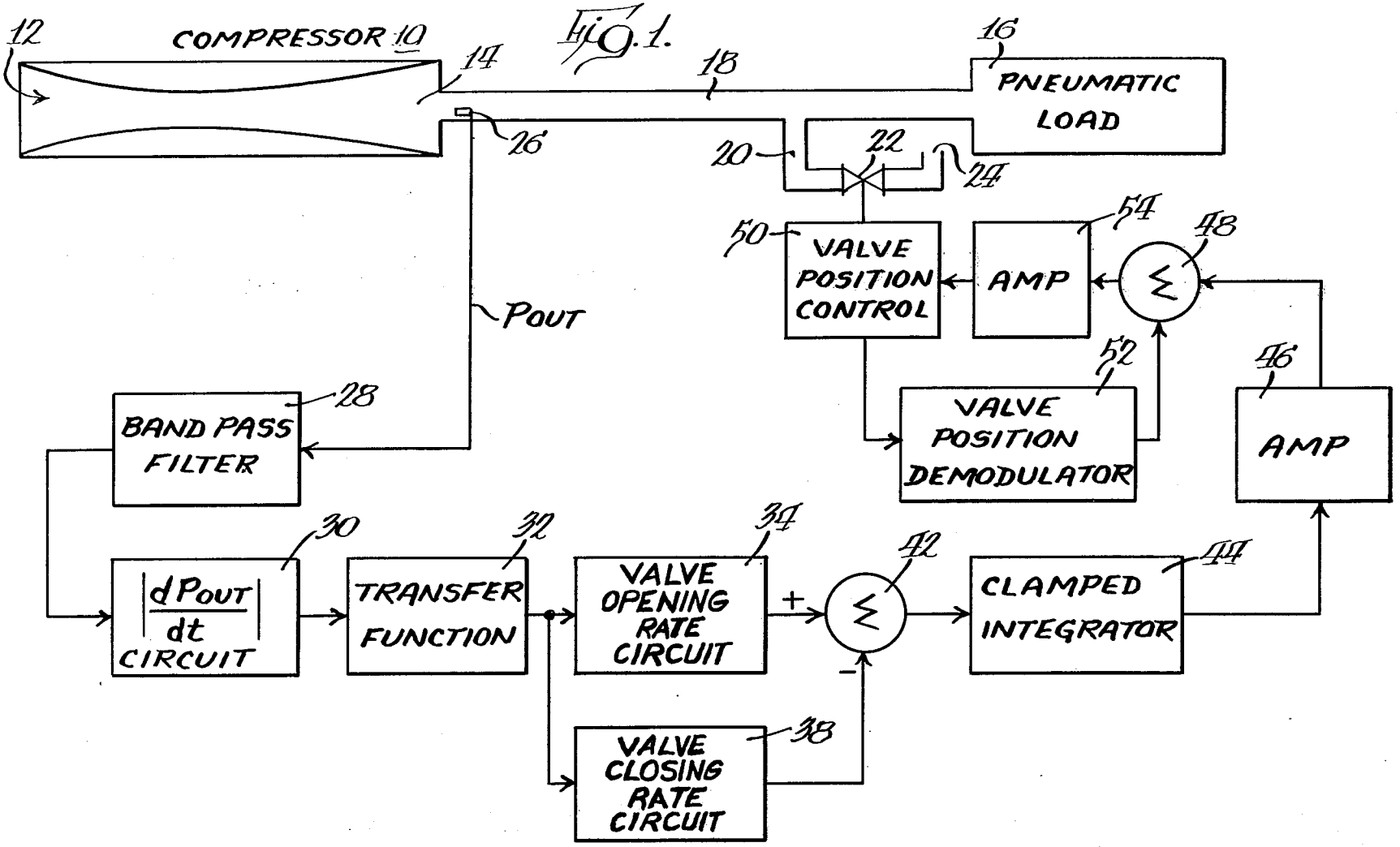
FIG. 1 is a block diagram of the surge control system of the present invention.

Referring to FIG. 1, a surge control system for a fixed or variable speed, fixed or variable geometry compressor 10 is shown. The compressor shown in FIG. 1 is an axial compressor, although the present invention is capable of providing surge control for any type of compressor having surge maps similar to those shown in the two applications of Timothy F. Glennon et al, entitled "SURGE CONTROL FOR VARIABLE SPEED VARIABLE GEOMETRY COMPRESSORS" and "COMPRESSOR SURGE CONTROL WITH AIR FLOW MEASUREMENT" filed contemporaneously herewith and assigned to the assignee of the present invention.

The compressor 10 has an air-receiving inlet 12 and an outlet 14 which supplies compressed air to a pneumatic load 16 by a pneumatic conduit 18 coupled between load 16 and outlet 14. A venting conduit 20 is coupled in parallel with load 16. The position of a dump valve 22 determines the amount of air vented from a vent 24.

A pressure transducer 26 provides a signal proportional to the outlet pressure $P_{out}$ and may be of any suitable type well known to those in the art. The signal proportional to $P_{out}$ is applied to a band pass filter 28 to remove noise and undesirable signal frequencies. The signal from the band pass filter 28 is applied to the $|dP_{out}/dt|$ circuit 30. Circuit 30 differentiates $P_{out}$ with respect to time and then provides the absolute value of the $|dP_{out}/dt|$. The output from circuit 30 is a voltage which represents the absolute value of the rate of change of the output pressure $P_{out}$ with respect to time.

During steady state operation, when the compressor is operating on the normal operating line of the surge compressor map, $|dP_{out}/dt|$ oscillates at a measurable value hereinafter referred to as $|dP_{out}/dt|$ ref. When $|dP_{out}/dt|$ is greater than $|dP_{out}/dt|$ ref, a surge condition can be anticipated. When $|dP_{out}/dt|$ is less than $|dP_{out}/dt|$ ref, the compressor is operating in the normal operating region, below the normal operating line on the surge map.

Figures 2, 3, 4:
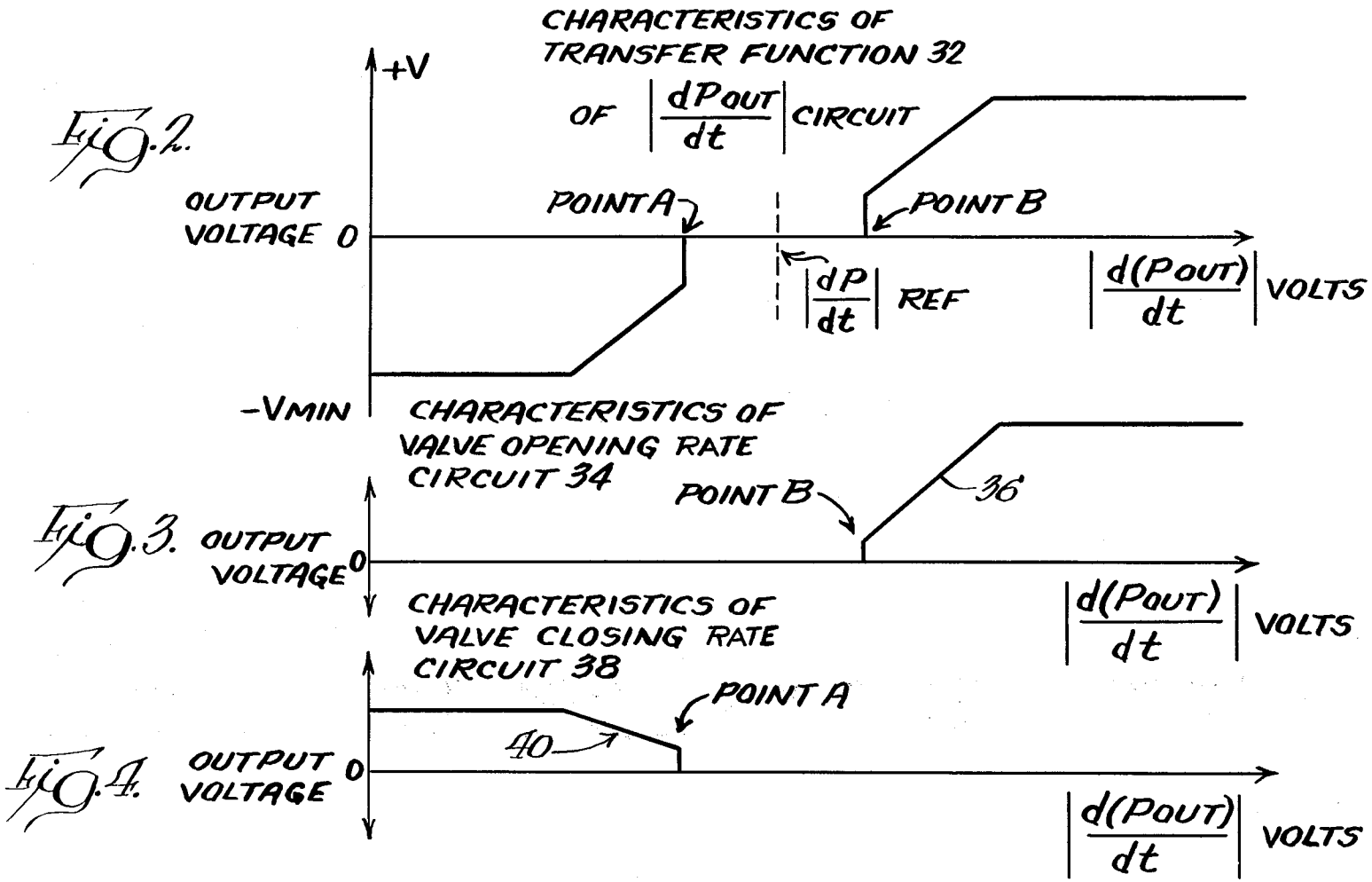
FIG. 2 depicts the characteristics of the transfer function shown in FIG. 1.
FIG. 3 depicts the characteristics of the valve opening circuit of FIG. 1.
FIG. 4 depicts the characteristics of the valve closing circuit of FIG. 1.

The signal from circuit 30 is applied to a transfer function 32, the characteristics of which are best seen in FIG. 2. The output of the transfer function is a voltage having a magnitude which is a function of $|dP_{out}/dt|$. Specifically, the output of transfer function circuit 32 is zero for a $|dP_{out}/dt|$ voltage about $|dP_{out}/dt|$ ref between point A and point B. The output from the transfer function becomes more positive as $|dP_{out}/dt|$ increases above point B until it reaches a maximum of +V volts. Similarly, the output of the transfer function circuit 32 decreases from $|dP_{out}/dt|$ ref in an amount proportional to the decrease in $|dP_{out}/dt|$ until a minimum of −V volts is reached. Providing zero volts from transfer function 32 between points A and B, about $|dP_{out}/dt|$ ref, prevents oscillations in the surge control valve, as will become apparent.

The signal from transfer function 32 is applied to a valve opening rate circuit 34. Valve opening rate circuit 34 is responsive to a voltage of one polarity, as a positive voltage, from transfer function 32, and has an output characteristic as shown in FIG. 3. Specifically, as the value of $|dP_{out}/dt|$ increases beyond point B, the output of the valve opening rate circuit 34 increases in an amount proportional to the increase. The gain of the valve opening rate circuit 34, as indicated by a slope 36, is selected to be high to rapidly open valve 22, as will be discussed below.

The signal from transfer function 32 is also applied to valve closing rate circuit 38. The valve closing rate circuit 38 has an output characteristic as shown in FIG. 4. Specifically, as the valve of $|dP_{out}/dt|$ decreases beyond point A, the output of valve closing rate circuit 38 decreases in an amount proportional thereto. The gain of the valve closing rate circuit 38, as indicated by a slope 40, is selected less than that of valve opening rate circuit 34 to slowly close valve 22, as will be discussed below.

The outputs from valve opening rate circuit 34 and valve closing rate circuit 38 are applied to a summer 42. If $|dP_{out}/dt|$ is less than $|dP_{out}/dt|$ ref, the output from summer 42 will be zero, or negative. If $|dP_{out}/dt|$ is greater than the value of $|dP_{out}/dt|$ at point B in FIG. 2, the output for summer 42 will be positive. The output from summer 42 is hereinafter referred to as the vent valve command signal and controls the position of valve 22.

The vent valve command signal is applied to clamped integrator 44. The output of clamping integrator 44 is a zero or non-zero value K when the vent valve command signal is zero. If $|dP_{out}/dt|$ increases past point B, the vent valve command signal becomes positive, causing the output of clamping integrator 44 to increase, following slope 36 (FIG. 3). This causes valve 22 to open. As more air is vented from vent 24, $P_{out}$ becomes less and $|dP_{out}/dt|$ decreases. When $|dP_{out}/dt|$ decreases to a point less than point A, the vent valve command signal becomes negative, causing the output of clamping integrator 44 to return to zero or to A, following slope 40 (FIG. 4).

The output of clamping integrator 44 is applied to an amplifier 46 which tailors the steady state and transient response to the system.

The output of amplifier 46 is applied to a summer 48. The position of valve 22 is controlled by a valve position control circuit 50 in response to the magnitude of the signal applied to summer 48. An increase in voltage from summer 48 causes valve 22 to open farther, and a decrease causes valve 22 to close. A valve position demodulator 52 provides negative feedback to summer 48 to assure that the valve position with respect to the valve command control signal is maintained. An amplifier 54 is coupled between summer 48 and valve position control circuit 50, and its gain is selected in accordance with the operating parameters of the system.

We claim:

1. A control system for preventing surge in a compressor which supplies air to a pneumatic load comprising:

means for sensing the air pressure at the outlet of the compressor;

means for generating a signal proportional to the absolute value of the rate of change of the air pressure;

means for generating a first control signal if said signal proportional to the absolute value is greater than a first value;

means for generating a second control signal if said signal proportional to the absolute value is less than a second value;

means for summing said first control signal with said second control signal; and means coupled to said summing means for generating a valve open signal when said first control signal is received from said summer, and for generating a valve closed signal when said second control signal is received from said summer.

2. The control system of claim 1 wherein said means for generating a valve open command signal and a valve closed command signal is a clamped integrator circuit for providing a voltage of a selected polarity.

3. The control system of claim 1 wherein the means for generating a first control signal has a higher gain than said means for generating a second control signal.

4. The control system of claim 1 wherein said first value is of greater magnitude than said second value.

5. A system for controlling surge in a compressor which supplies air to a pneumatic load comprising:

a sensor coupled to the output of the compressor for sensing the outlet pressure;

a first circuit for providing a signal proportional to the absolute value of the first derivative of the outlet pressure;

means for generating a first voltage if said signal is greater than a first value and for generating a second voltage if said signal is less than a second value;

a second circuit having a first gain coupled to said generating means for multiplying said first voltage by the first gain;

a third circuit having a second gain coupled to said generating means for multiplying said second voltage by the second gain;

means coupled to said second and third circuits for summing the signals from said circuits to provide a vent valve command signal;

an integrator responsive to said summer output for providing an output voltage; and a valve coupled between the output of the compressor and the load for venting air in an amount proportional to said output voltage.

* * * * *